US009580291B2

(12) United States Patent
van Haperen et al.

(10) Patent No.: US 9,580,291 B2
(45) **Date of Patent: *Feb. 28, 2017**

(54) BEVERAGE DISPENSER WITH WATER COOLER

(75) Inventors: Bartholomeus Johannes Antonius van Haperen, Vlaardingen (NL); Posan Pang, Datchet (GB); Miles Richard Macintosh Pennington, Teddington (GB); Jonkheer Theodoor Hendrik van de Poll, Vlaardingen (NL); Anthony Edward Quinn, Sharnbrook (GB); James Matthew Slater, Paris (FR)

(73) Assignee: CONOPCO, INC., Englewood Cliffs, NJ (US)

( * ) Notice: Subject to any disclaimer, the term of this patent is extended or adjusted under 35 U.S.C. 154(b) by 580 days.

This patent is subject to a terminal disclaimer.

(21) Appl. No.: 13/516,805

(22) PCT Filed: Nov. 29, 2010

(86) PCT No.: PCT/EP2010/068402

§ 371 (c)(1),
(2), (4) Date: Oct. 2, 2012

(87) PCT Pub. No.: WO2011/076521

PCT Pub. Date: Jun. 30, 2011

(65) Prior Publication Data

US 2013/0015206 A1 Jan. 17, 2013

(30) Foreign Application Priority Data

Dec. 22, 2009 (EP) ..... 09180297

(51) Int. Cl.

| | |
|---|---|
| ***B67D 7/74*** | (2010.01) |
| ***B67D 3/00*** | (2006.01) |
| ***B67D 1/00*** | (2006.01) |

(52) U.S. Cl.
CPC ..... *B67D 3/0038* (2013.01); *B67D 1/0051* (2013.01); *B67D 1/0052* (2013.01);
(Continued)

(58) Field of Classification Search
CPC .. B67D 1/0052; B67D 3/0009; B67D 3/0019; B67D 3/0032; B67D 3/0035; B67D 3/0038
(Continued)

(56) References Cited

U.S. PATENT DOCUMENTS

| | | | |
|---|---|---|---|
| 3,688,950 | A | 9/1972 | Parish |
| 3,723,851 | A | 3/1973 | Johnson et al. |

(Continued)

FOREIGN PATENT DOCUMENTS

| | | | |
|---|---|---|---|
| CA | 2510733 | A1 | 6/2005 |
| EP | 0736483 | A1 | 10/1996 |

(Continued)

OTHER PUBLICATIONS

International Search Report, PCT/EP2010/068402, mailed Feb. 21, 2011, 4 pp.

(Continued)

*Primary Examiner* — Patrick M Buechner
(74) *Attorney, Agent, or Firm* — Foley & Lardner LLP

(57) ABSTRACT

A beverage dispenser (11) is disclosed for use in combination with a water cooler, wherein the water cooler comprises a water bottle (1) and a cooler housing (2) comprising an outlet (3, 4) for dispensing water, and wherein the beverage dispenser is intended to be positioned between the cooler housing and the water bottle. The beverage dispenser comprises: a dispensing station (19), a conduit (13) for supply of water from the water cooler to the dispensing station, a connector (22) for attachment to a container (12) comprising concentrate, a conduit (23) for supply of concentrate from
(Continued)

the container to the dispensing station, and a passage (120) to allow the water bottle (1) to remain in fluid communication with the outlet (3,4) of the cooler housing (2) when the dispenser (11) is positioned between the cooler housing and the water bottle.

9 Claims, 4 Drawing Sheets

(52) U.S. Cl.
CPC ..... *B67D 3/0009* (2013.01); *B67D 3/0012* (2013.01); *B67D 3/0019* (2013.01); *B67D 3/0029* (2013.01); *Y10T 29/49716* (2015.01)

(58) Field of Classification Search
USPC ..... 222/129.1, 146.6, 185.1
See application file for complete search history.

(56) References Cited

U.S. PATENT DOCUMENTS

| | | | | |
|---|---|---|---|---|
| 3,986,642 | A | 10/1976 | Selvia et al. | |
| 4,392,588 | A | 7/1983 | Scalera | |
| 4,915,261 | A * | 4/1990 | Strenger | 222/92 |
| 5,003,790 | A | 4/1991 | Goupil | |
| 5,310,088 | A | 5/1994 | Burrows | |
| 5,758,571 | A | 6/1998 | Kateman et al. | |
| 6,073,539 | A | 6/2000 | Triola et al. | |
| 6,167,921 | B1 | 1/2001 | Busick et al. | |
| 6,286,564 | B1 | 9/2001 | Wallace | |
| 6,935,533 | B2 | 8/2005 | Clausen et al. | |
| 7,083,071 | B1 | 8/2006 | Crisp, III | |
| 7,328,818 | B2 | 2/2008 | Prabucki | |
| 7,651,008 | B2 | 1/2010 | Sher et al. | |
| 7,651,010 | B2 | 1/2010 | Orzech et al. | |
| 7,798,054 | B2 * | 9/2010 | Evers et al. | 99/295 |
| 9,399,570 | B2 * | 7/2016 | van Haperen | B67D 3/0029 |
| 2002/0040585 | A1 | 4/2002 | Chaney | |
| 2002/0129869 | A1 | 9/2002 | Hydak et al. | |
| 2002/0130140 | A1 | 9/2002 | Cote | |
| 2004/0112917 | A1 | 6/2004 | Groesbeck | |
| 2005/0121466 | A1 | 6/2005 | Sher et al. | |
| 2005/0133532 | A1 | 6/2005 | Crisp, III et al. | |
| 2006/0045942 | A1 | 3/2006 | Sher et al. | |
| 2006/0249536 | A1 | 11/2006 | Hartman et al. | |
| 2007/0000949 | A1 | 1/2007 | Bosi | |
| 2007/0062972 | A1 | 3/2007 | Feldman et al. | |
| 2007/0080169 | A1 | 4/2007 | Sher et al. | |
| 2007/0272620 | A1 | 11/2007 | Chaney | |
| 2008/0041493 | A1 | 2/2008 | Lin et al. | |
| 2008/0148948 | A1 | 6/2008 | Evers et al. | |
| 2011/0011273 | A1 * | 1/2011 | Evers | A47J 31/407 99/295 |
| 2011/0215114 | A1 | 9/2011 | Liccioni | |
| 2011/0284585 | A1 | 11/2011 | Stewart-Barnett | |
| 2012/0326437 | A1 | 12/2012 | Santos | |
| 2013/0171320 | A1 | 7/2013 | Scholvinck et al. | |
| 2014/0239013 | A1 | 8/2014 | Santos | |

FOREIGN PATENT DOCUMENTS

| | | | |
|---|---|---|---|
| EP | 1806314 | A1 | 11/2007 |
| GB | 2256636 | A | 12/1992 |
| GB | 2403710 | | 1/2005 |
| JP | 07125798 | | 5/1995 |
| JP | 07137792 | | 5/1995 |
| JP | 09278092 | | 10/1997 |
| JP | 2007045496 | | 2/2007 |
| JP | 2011131936 | | 7/2011 |
| WO | WO9001449 | | 2/1990 |

OTHER PUBLICATIONS

European Search Report, EP 09 18 0297, dated Jul. 9, 2010, 2 pp.
Search report in EP09180292, Jul. 23, 2010.
Search Report in PCTEP2010068397, Feb. 14, 2011.
Written Opinion in EP09180292, Jul. 23, 2010.
Written Opinion in PCTEP2010068397, Feb. 14, 2011.
Written Opinion in EP09180297, Jul. 9, 2010.

* cited by examiner

BEVERAGE DISPENSER WITH WATER COOLER

Under Request for Continued Application procedure (RCE), this is a continuing application of Ser. No. 13/516,805 filed Oct. 2, 2012.

FIELD OF THE INVENTION

The present invention is in the field of beverage dispensers that are used in combination with water coolers. The invention also relates to a method for modifying a water cooler, a water cooler and a kit for modification of a water cooler.

BACKGROUND OF THE INVENTION

Water coolers can be found in many offices and workplaces. Typically water coolers are provided for the supply of a fresh cup of cold or ambient water to a consumer. These water coolers generally consist of a cooler housing upon which a water bottle is put upside down. Usually the cooler housing contains a cooling device, a reservoir for cold water, and two water taps, for cold water and ambient water respectively. Part of the water from the bottle is cooled by the cooling device and temporarily stored in the reservoir prior to serving.

In general, in addition to water, the consumer may like to have a larger choice of beverages in order to quench his or her thirst. This would generally require that an additional beverage dispenser or a set of bottles containing, for example, fruit juice concentrates or syrups will be placed into the office. However, floor space is usually limited in offices, and additional dispensers are expensive and cost, in addition to space, a lot of energy for cooling. Therefore there is a need for cheap beverage dispensers which can be fitted to existing conventional water coolers, and with which beverages, in addition to water, can be supplied. Nowadays one of the beverages that is becoming more and more popular is ice tea, as this is a refreshing drink, containing healthy antioxidants and may contain less sugar than regular soft drinks.

A conventional way of making beverages in a dispenser is dilution of a concentrate with water. The concentrate is contained in a separate container, and after mixing a fixed amount of concentrate with a fixed amount of water, a ready to drink beverage is obtained.

Numerous types of beverage dispensers and water coolers are available on the market.

GB 2,403,710 discloses a dispenser for fruit concentrate in conjunction with a known water cooler. The dispenser comprises means into which a conventional concentrate bottle can be screwed by its neck whilst upright, then rotated to a vertical dispense position. The dispenser is attached to the side of a water cooler.

US 2005/0121466 discloses a device for dispensing a beverage comprising a mixture of liquid, e.g. water, and at least one liquid concentrate, comprising at least two liquid nozzles connected respectively to at least one liquid source for producing a first jet of liquid in air along first path and a second jet of liquid in air along a second path, at least one concentrate nozzle connected to at least one liquid concentrate source for delivering a stream of liquid concentrate in air along a third path, wherein the liquid nozzles and the concentrate nozzle are oriented with respect to each other so that the first, second and third paths intersect above a container at a common intersection point, whereby the mixture is formed by collision of the respective jets and the stream(s).

Furthermore, beverage mixers and dispensers which may use a conventional bottled water cabinet supporting a conventional bottle have been described.

For example, U.S. Pat. No. 3,723,851 discloses a beverage mixer and dispenser utilizing a bottled water holding cabinet which supports a water container and a plurality of flavor liquid containers; all of said containers being disposed for gravity-responsive delivery of liquids therefrom; and a dispensing and mixing valve below all of said containers; said valve having a rotatable and reciprocable valve member which may be rotated to any one of several selective positions communicating with any one of said flavor liquid containers; and said valve member may be reciprocably actuated against spring pressure to cause concurrent communication of said water container and one of said flavor liquid containers with a common outlet, of said valve, through which the water and a selected flavor liquid may be mixed and dispensed to a drinking receptacle.

Unfortunately the use of a common outlet to mix the flavour liquid and water as described in U.S. Pat. No. 3,723,851 may result in contamination of the dispensing valve with the final beverage which, unless complex cleaning means are included in the dispenser, may result in hygiene problems and/or carry-over of flavour from one type of beverage to another.

We have recognised that there is a need for providing a beverage dispenser for use with a water cooler, which can allow for the serving of flavoured beverages in addition to unflavoured water and without the risk of carry-over of flavour from the flavoured beverages and the cleaning requirements that such carry-over necessitates.

SUMMARY OF THE INVENTION

The object of the present invention is to provide a simple beverage dispenser that can easily be fitted to a conventional water cooler, therewith creating an extra choice of beverage for the consumer whilst still allowing the water-dispensing outlet of the water cooler to operate. Another object is to provide a beverage dispenser that is hygienic, in order to minimise cleaning requirements. A further object is to provide a beverage dispenser that dispenses a beverage into a cup without splashing.

It was found that one or more of these objects could be achieved by a beverage dispenser that is fitted to a conventional water cooler, by positioning it between the water bottle and the cooler housing and which is provided with a passage to allow the water bottle to remain in fluid communication with a water outlet of the cooler housing.

In a first aspect the present invention provides a beverage dispenser for use in combination with a water cooler, wherein the water cooler comprises a water bottle and a cooler housing comprising an outlet for dispensing water, and wherein the beverage dispenser is intended to be positioned between the cooler housing and the water bottle, wherein the beverage dispenser comprises:

- a dispensing station,
- a conduit for supply of water from the water cooler to the dispensing station,
- a connector for attachment to a container comprising concentrate,
- a conduit for supply of concentrate from the container to the dispensing station, and wherein the dispenser comprises a passage therethrough to allow the water bottle to remain in fluid communication with the outlet of the cooler housing when the dispenser is positioned between the cooler housing and the water bottle.

In another aspect, the present invention provides a method for modifying a water cooler using the beverage dispenser of the first aspect, comprising the following steps in any order:

- positioning the dispenser between the cooler housing and the water bottle with the passage positioned to allow water to flow from the water bottle to the outlet of the cooler housing;
- arranging the conduit for supply of water to be in fluid communication with water in the water cooler,
- attaching the connector to the container to allow concentrate within the container to be in fluid communication with the conduit for supply of concentrate.

In a further aspect the present invention provides a water cooler, wherein the water cooler comprises a cooling device and a water bottle, and wherein the beverage dispenser of the first aspect is positioned between the cooler housing and the water bottle.

In a still further aspect, the present invention provides a kit for modification of a water cooler, comprising the beverage dispenser of the first aspect, a conversion set, and written instructions on how to modify the water cooler with the beverage dispenser.

DETAILED DESCRIPTION OF THE INVENTION

The present invention provides one or more of the following advantages: The beverage dispenser can easily be fitted to an existing water cooler and gives the consumer an alternative choice of beverage. Moreover neither an additional beverage dispensing machine nor appended bottles containing (fruit) concentrates are needed. In one single action, by pressing one button on the beverage dispenser of the invention, the consumer receives a ready to drink beverage that is well-mixed, with an optimal taste, as the dispenser supplies the correct amount of water and concentrate to make a beverage having the right composition. The beverage dispenser of the present invention makes use of the facilities of the water cooler, hence no additional cooling machine and cold water supply are required, and additionally no extra floor space is needed for the beverage dispenser. Due to the design of the dispenser, the beverage dispenser can have minimal cleaning requirements, making it a hygienic device. The beverage dispenser does not need a mixing chamber where the water and concentrate are mixed. Usually such a mixing chamber needs daily cleaning, which is not needed for the present invention. Concentrate from a container in the beverage dispenser and water from the water cooler can each be connected to dedicated nozzles, pump heads and conduits. Jets of water and concentrate flowing from the nozzles can be mixed in air when dispensing a beverage. This all can lead to prevention of contamination of parts of the beverage dispenser. A cup that is standing underneath the mixing point of the jets, can be filled with the ready-to-drink beverage, after mixing the concentrate with water.

Another advantage of the present invention which is especially due to the presence at the passage through the dispenser is that pure water can be exclusively dispensed from the existing water outlet of the water cooler. The original water cooler and its outlet (e.g., taps) remain intact. The water flows through a passage which is dedicated for water, and this part of the beverage dispenser need not be used for concentrate or beverage. Therewith the water remains pure, without possibility that taste components are transferred from the concentrate to the water flow, as may happen in beverage dispensers that do not have exclusive conduits for water. Furthermore, by separation of the dispense positions for ready to drink beverage and water, the risk is minimised that the consumer presses the wrong button and therewith receives water instead of ready to drink beverage or ready to drink beverage when he or she would like to have a cup of water.

Definitions

The following terms have the following meaning in the context of the present invention.

- Beverage dispenser: a device to be used in combination with a water cooler, wherein the water cooler comprises a cooler housing and a water bottle, and the beverage dispenser is intended to be positioned between the cooler housing and the water bottle, and the beverage dispenser comprises a dispensing station whereat a beverage other than water may be dispensed. The preferred beverage dispensers are those adapted to be removably positioned between the housing and the water bottle, wherein "removably" means that the dispenser may be positioned and removed without affecting the normal operation of the water cooler.
- Water cooler: a device that can cool and dispense water, and that can contain a water bottle and a cooler housing upon which the water bottle is put upside down.
- Cooler housing: a structural element that supports a water bottle and forms the base of the water cooler, contains a cooling device and comprises a reservoir containing cold water, and which also comprises an outlet for dispensing water, for example, one or more taps.
- Cooling device: a device that cools the water from the bottle, located in the cooler housing, typically towards the bottom thereof.
- Conversion set: provides means to fit a beverage dispenser to different types, configurations, and brands of water coolers and cooler housings.
- Dispensing station: a station at a beverage dispenser or water cooler where a receptacle (such as a disposable cup) can be placed or held whilst a beverage is dosed therein.
- Concentrate: a beverage precursor which can be diluted with water to provide a palatable beverage. Typically the concentrate will have a solids content of at least 3% by weight, more preferably at least 10% by weight, more preferably still at least 15% by weight and most preferably from 20 to 80% by weight. Within the context of this application concentrate encompasses beverage precursors like fruit juice concentrates, syrups (a thick, viscous liquid, containing a large amount of dissolved sugars and the like) and the like. Moreover the invention also encompasses the possibility to use diluents other than water, e.g. alcoholic drinks, milk, or any other consumable liquid.
- Tea: material derived from *Camellia sinensis* var. *sinensis* or *Camellia sinensis* var. *assamica*. It also includes rooibos tea obtained from *Aspalathus linearis*. "Tea" is also intended to include the product of blending two or more of any of these materials. A "tea-based" concentrate is one which comprises solids derived from tea. Typically a tea-based concentrate will comprise at least 0.5% by weight tea solids, more preferably at least 1% and most preferably from 3 to 50%.

DESCRIPTION OF THE DRAWINGS

The invention is illustrated by the drawings, in which.

WATER COOLER AND BEVERAGE DISPENSER

Figure 1:
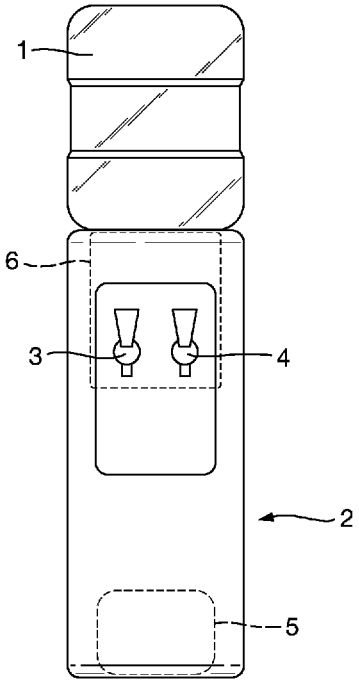
FIG. 1 shows a schematic drawing of a water cooler.

The water cooler as illustrated in FIG. 1 is a conventional water cooler, as can be found in many offices and work places world wide. The illustrated water cooler comprises a water bottle (1) and a cooler housing (2), upon which the water bottle (1) is seated upside down (i.e. with the opening of the bottle at the bottom thereof). The volume of the water bottle (1) can be, for example, up to about 20 litres. The cooler housing (2) can be regarded to be a cylinder (or box or any other shape) that usually contains a cooling device (5) on the bottom and a reservoir (6) containing cold water. Generally the cooling device (5) on the bottom and a reservoir (6) are not visible from the outside. Water flows through conduits from bottle (1) through cooling device (5), to cold water reservoir (6). Cups can be filled with water using the water outlet in the cooler housing which here is embodied by water taps (3) and (4) for cold water and ambient water, respectively. The water from cold water tap (3) is supplied from reservoir (6), while the water from tap (4) is not cooled and is supplied from bottle (1) directly. Some water coolers can, in addition to cold and ambient water, also supply heated water. In that case, the cooler housing will also comprise a heating system for water, and a warm water reservoir. FIG. 1 does not indicate conduits, connectors, and valves between the different elements of the water cooler. These parts would be apparent for a person skilled in the art.

Figure 2:
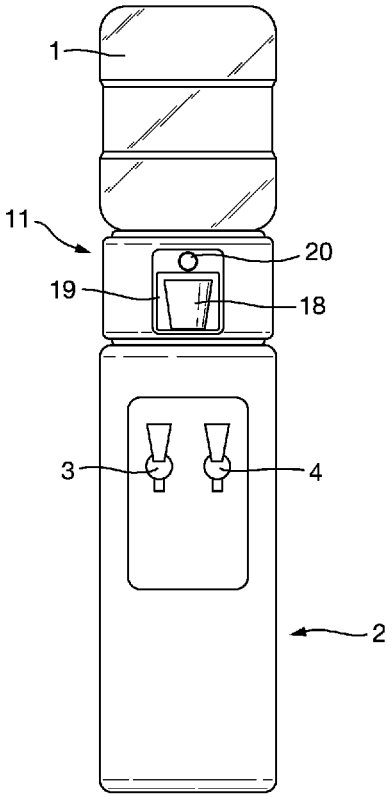
FIG. 2 shows a schematic drawing of the water cooler of FIG. 1 but modified with an embodiment of a beverage dispenser according to the invention.

A preferred embodiment of the current invention is illustrated in FIG. 2: a beverage dispenser (11) that is fitted to an existing water cooler. The beverage dispenser is positioned on the cooler housing (2), and the water bottle (1) is put upside down on top of the beverage dispenser (11). The beverage dispenser (11) is fitted to the cooler housing by means of a conversion set. Using such a conversion set, conduits and other parts can be fitted between the beverage dispenser and water cooler. The conversion set comprises means to fit the beverage dispenser to different types, configurations, and brands of water coolers and cooler housings.

Figure 3:
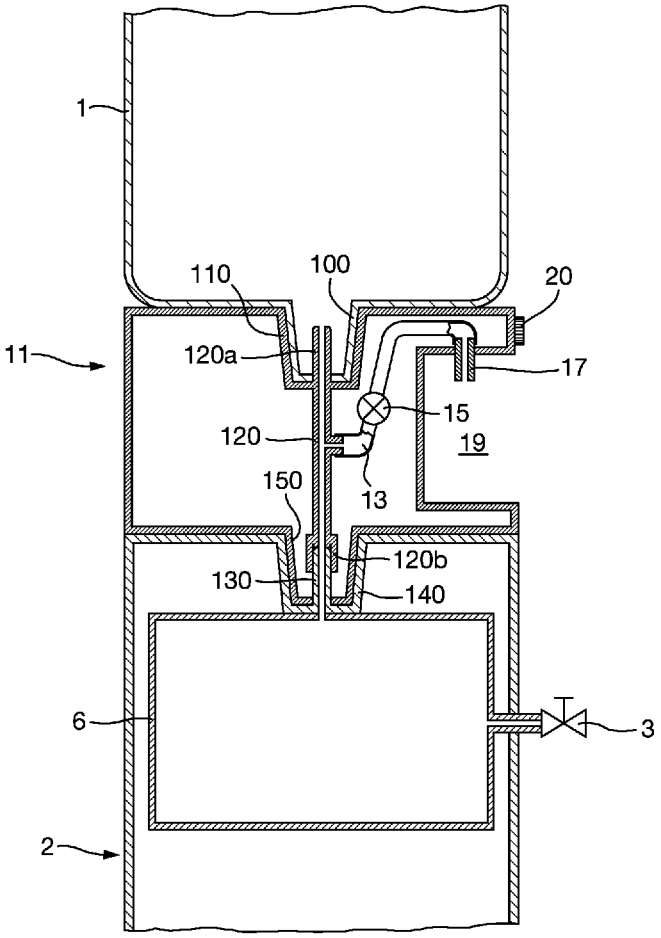
FIG. 3 shows a schematic cross-sectional view of part of a water cooler modified with an embodiment of a beverage dispenser according to the invention.

A more detailed understanding of the relationship between the bottle (1), dispenser (11) and housing (2) can be appreciated from FIG. 3. In this embodiment the cooler housing (2) comprises a recess (140) in the top surface thereof. The housing recess (140) is shaped to receive a neck (100) of the water bottle (1) and sealingly engage therewith. The housing recess (140) has centrally disposed therein a hollow spigot (130) arranged in normal use to pierce the neck (100) of the bottle (1) to allow water to flow from the bottle (1), through the housing spigot (130) and into the reservoir (6) which is connected to the cold-water tap (3). The beverage dispenser (11) in the embodiment illustrated in FIG. 3 has a protrusion (150) on the bottom surface thereof and a recess (110) on the top surface thereof. The protrusion (150) is shaped to mimic exactly the form and dimensions of the bottle neck (100) such that the protrusion (150) is received in and forms a sealing fit with the housing recess (140). Similarly, the dispenser recess (110) is shaped to mimic exactly the form and dimensions of the housing recess (140) such that the dispenser recess (110) receives and forms a sealing fit with the bottle neck (100). In addition, the dispenser shown in FIG. 3 comprises a hollow spigot (120) centrally disposed therein and which has a top end (120*a*) located centrally within the dispenser recess (110) and which is arranged to pierce the bottle neck (100) in the same manner as the housing spigot (130) would in normal use. The bottom end (120*b*) of the dispenser spigot (120) is shaped to receive and form a sealing fit with the housing spigot (130). As may be appreciated, with the dispenser (11) positioned between the water bottle (1) and housing (2), water may flow from the bottle (1) into the top end (120*a*) of the dispenser spigot, through the dispenser spigot (120) and the housing spigot (130) and into the reservoir (6), wherefrom it may be dispensed by means of the tap (3). Thus, in the embodiment shown in FIG. 3, the dispenser spigot (120) provides a passage through the dispenser (11) which allows water in the bottle (1) to be in fluid communication with an outlet in the housing (2), which in this embodiment is a tap (3).

It will be appreciated that the exact shape and size of the various parts of the dispenser (11) may not match every brand and design of water cooler. Thus, for example, for the dispenser shown in FIG. 3, the protrusion (150), recess (110), spigot top (120*a*) and/or spigot bottom (120*b*), may be modified by the addition of components from the conversion set to allow for sealing engagement with the respective parts of the bottle (1) or housing (2) described above.

Although the modified water coolers illustrated in FIGS. 2 and 3 comprise a single beverage dispenser (11), the water cooler may comprise 1 to 4 beverage dispensers according to the invention that are positioned between the cooler housing (2) and the water bottle (1), provided that the passage of each dispenser is positioned to allow water to flow from the water bottle to the outlet of the cooler housing. Two or more beverage dispensers (11) may be fitted to a water cooler, therewith providing the consumer a larger choice of beverages, without the need of extra floor space or an additional cooling machine or water supply. The beverage dispensers may be designed in such a way that one dispenser can be regarded as a ring or cylinder. The beverage dispensers can be stacked, and a second beverage dispenser can be put upon the first dispenser, and the water bottle is then put upon the second dispenser. The number of beverage dispensers per water cooler is limited by the height at which it is still practical to take a cup of beverage from the dispenser, and to which it is practical to replace the water bottle. Preferably the number of additional beverage dispensers per water cooler is between 1 and 3, more preferred 1 or 2. Another possibility is that a beverage dispenser is designed and constructed in the form of a wedge, and that for example 2 to 4 wedges together form a ring or cylinder. Each of the beverage dispensers in the shape of a wedge then contains the elements according to the invention, as will be described below. In all of these cases (beverage dispensers which are stacked or in the form of wedges), the conversion set will be designed in such a way that water can be supplied from the water cooler to each of the beverage dispensers as well as to the outlet of the housing.

The beverage dispenser is illustrated in FIG. 2 with a receptacle (18) positioned at a dispensing station (19) ready for receiving a dose of beverage which is dispensed on actuation of the button (20). The receptacle (18) for use with the dispenser of the present invention may be any suitable beverage holder and is preferable a cup, especially a disposable cup.

Figure 4:
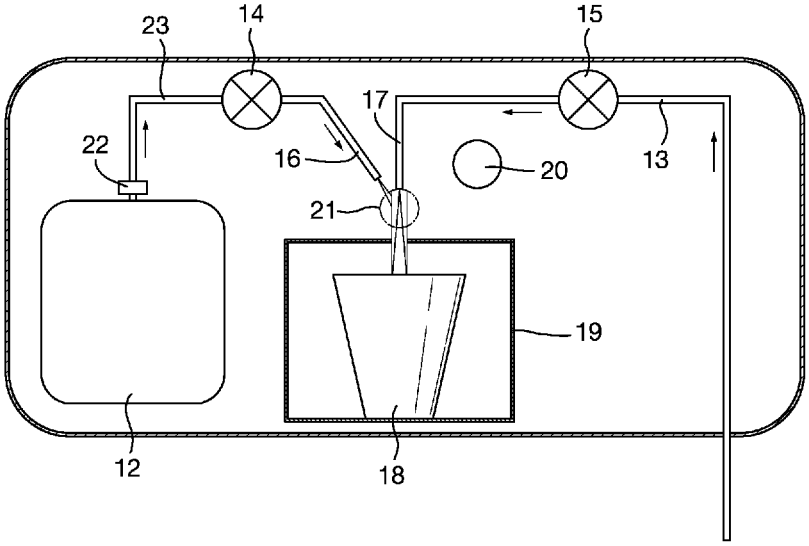
FIG. 4 shows a schematic drawing of parts of a beverage dispenser according to the invention.

The beverage dispenser according to the invention preferably comprises at least one container containing a concentrate, more preferably two or more containers containing concentrate. In the embodiment that is schematically illustrated in FIG. 4, the beverage dispenser (11) comprises a container (12) wherein beverage concentrate is contained. The container (12) could be any container which is conventionally used for storage of food-grade fluids, for example a bottle. Usually the volume of a container is 0.5 to 2 litres, although the container can have any volume, as long as the container fits in the dispenser. Preferably at least one of the containers is a single-use plastic bag.

A beverage dispenser according to the invention comprises a connector for attachment to a container comprising concentrate. In the embodiment of FIG. 4 the container (12) is in fluid communication with a conduit (23) for supply of concentrate from the container (12) to a dedicated concentrate nozzle (16) at the dispensing station (19). The conduit (23) is attached to the container (12) using a connector (22). The connector (22) may comprise any suitable mechanism to connect a container to the beverage dispenser, and this mechanism is adapted to the type of closure of the container (12). The concentrate is pumped through the concentrate conduit (23) by means of a first pump head (14).

Water may be supplied directly from the water bottle or from a supply in the cooler housing. Preferably, a conduit (13) for supply of water is arranged to be in fluid communication with water in the water cooler. In the embodiment illustrated in FIG. 4, the conduit (13) supplies cold water from the cold water reservoir (6) in the cooler housing (2) to a water nozzle (17) at the dispensing station (19), and the flow is controlled by a second pump head (15). In case that the water cooler is equipped with a warm water supply and a warm water reservoir, then the water conduit (13) may be connected to the warm water reservoir by means of the conversion set. Additionally or alternatively, as shown in the embodiment in FIG. 3, the water conduit (13) may be in fluid communication with the passage (in this case formed by dispenser spigot (120)) to allow water to be pumped, using the second pump head (15), from the passage to the water nozzle (17) at the dispensing station (19). Note that the container, connector, concentrate conduit and other elements are not illustrated in FIG. 3 for clarity's sake.

Pump heads (14) and (15) may be driven by a single dual-head pump, or by two separate pumps each with one pump head. On actuation of button (20), the pump heads (14, 15) are started simultaneously, and a preset amount of concentrate and water are dispensed. A preferred form of dispensing is illustrated in FIG. 4 wherein concentrate flows out of the concentrate nozzle (16) as a jet into air and a preset amount of water flows out of the water nozzle (17) as a jet into air. The nozzles (16) and (17) are oriented such that the two jets are mixed at a common intersection point (21), before falling as the mixed beverage into a receptacle (18), standing in dispensing station (19).

Figure 5:
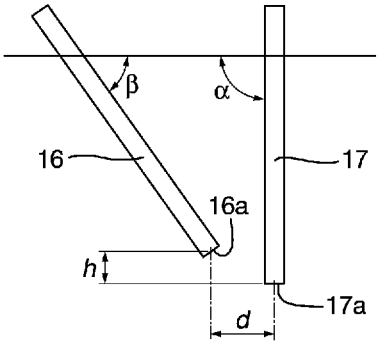
FIG. 5 shows an enlargement of the nozzles of the beverage dispenser of FIG. 4.

The relative position of the nozzles (16) and (17) is preferably optimised in order to obtain good mixing, while preventing splashing of beverage and therewith avoiding extra cleaning requirements. The positioning of the nozzles is illustrated with reference to FIG. 5. The angle ($\alpha$) of the water nozzle (17) relative to the horizontal is preferably between 45° and 90°, more preferably between 75° and 90°, and most preferably about 90°, meaning that most preferably the nozzle (17) is vertical or nearly vertical. The angle ($\beta$) of the concentrate nozzle (16) relative to the horizontal is preferably between 25° and 90°, more preferably between 45° and 75°, and most preferably between 50° and 60°. It is especially preferred that the angle ($\alpha$) of the water nozzle is greater than the angle ($\beta$) of the concentrate nozzle. To ensure that the nozzles are arranged such that water dispensed from the water nozzle and concentrate dispensed from the concentrate nozzle intersect, their arrangement is preferably such that they are present in the same vertical plane.

Preferably the diameter of the concentrate nozzle (16) is chosen smaller than the water nozzle (17) to create a high velocity out of the concentrate nozzle (16) and so being able to accurately direct the concentrate jet at the water jet. The internal diameter of the water nozzle (17) is preferably between 2 and 15 mm, more preferably between 4 and 10 mm. The internal diameter of the concentrate nozzle is preferably between 0.5 and 10 mm, more preferably between 1 and 5 mm.

The nozzles (16, 17) each have a dispensing opening (16*a*, 17*a*) and the horizontal and vertical distances between the centres of the openings of concentrate nozzle (16*a*) and water nozzle (17*a*) may also be optimised to prevent splashing. Preferably the horizontal distance (d) between the centres of the openings (16*a*, 17*a*) is between 5 and 20 mm, more preferably between 5 and 15 mm. The vertical distance (h) between the centres of the openings (16*a*, 17*a*) is preferably between 0 and 20 mm, more preferably between 0 and 10 mm. Preferably also, the opening (16*a*) of the concentrate nozzle (16) is positioned higher than the opening (17*a*) of the water nozzle (17).

In a preferred embodiment the beverage dispenser comprises two or more containers containing concentrate. Two or more containers, filled with different concentrates, connected with pump heads, conduits and nozzles, can be present in the beverage dispenser, to give the consumer more choice than only a cup of water from the water cooler and one beverage from the dispenser. Preferably each container (12) is connected to a dedicated pump head (14) a dedicated conduit (23) and dedicated concentrate nozzle (16). Also preferably the conduit (13) for supply of water from the water cooler is connected to a dedicated pump head (15) and a dedicated water nozzle (17). Each container can be connected to dedicated pump heads, conduits and nozzles, analogous to the first container (12), in order to prevent cross-contamination between different concentrate flavours. Consequently, the number of buttons (20) on the beverage dispenser is preferably at least equal to the number of containers in the beverage dispenser. The number of containers is limited by the space available within the beverage dispenser, and is preferably from 1 to 4, most preferred the number of containers is 2. Where a plurality of containers may be employed then the dispenser will comprise a plurality of connectors (22). Thus in a preferred embodiment the dispenser comprises at least two connectors, wherein each connector is for attachment to a container comprising concentrate. More preferably the dispenser comprises from 2 to 4 connectors.

To ensure a constant mix ratio of water and concentrate, pump heads (14, 15) are preferably used for both liquids so as to be independent of gravity's influence on flow speed. In order to facilitate mixing, the pump heads can operate in a constant flow mode, or in a pulsating flow mode while dispensing water and concentrate. Positive displacement pumps and peristaltic pumps can be applied, where the peristaltic pumps are most suitable for pulsating flow. Preferably the water flow is operated in a constant flow mode, while the concentrate flow is operated in a constant or pulsating flow mode. Most preferably both concentrate pump head (14) and water pump head (15) operate in constant flow mode when beverage is dispensed.

The volumes that pump heads (14) and (15) discharge are based on the required dilution ratio and required total beverage volume, and can be adjusted by an operator. Preferably the concentrate is a tea-based concentrate, from which a fresh and cool ready to drink ice tea beverage can be made after dilution with water. Preferably at least one of the containers (12) contains a tea-based concentrate. If more than one container (12) is present, possibly the first concentrate is a regular ice tea concentrate, while a second concentrate may be any concentrate to be diluted to make a beverage. Examples of this are fruit juice concentrates, or lemonade syrups, and they may be sweetened using regular sweeteners like sugar, or non- or low-caloric sweeteners like aspartame or sucralose. The required dilution rate is dependent on the strength of the concentrate. The dilution ratio of concentrate to water is preferably between 1:1 and 1:20 (by volume), more preferably between 1:1 and 1:10 (by volume). The total volume of the dispensed beverage can be adjusted, and is preferably between 100 and 300 millilitres, more preferably between 150 and 250 millilitres per serving.

It should be noted that parts of the beverage dispenser like conduits, connectors, valves and an electronic control unit are not all indicated in the drawings. The omitted parts have been left out for clarity but these parts would be apparent to the person skilled in the art.

EXAMPLE

The following non-limiting example illustrates an embodiment of the present invention.

A beverage dispenser (11) as schematically indicated in FIG. 4 was manufactured and fitted between the cooler housing (2) and the water bottle (1) of a conventional water cooler (as illustrated in FIG. 2). The height of the beverage dispenser was 20 cm, and the diameter was equal to that of the cooler housing. Water was pumped from the cold water reservoir (6) in the cooler housing by a centrifugal pump and pump head (15)—the flow speed was regulated by a combination of the outlet diameter of conduit (13) and a valve restricting the water flow (not indicated in FIG. 4) at the inlet side. A 1 litre plastic bag (12) containing Lipton™ Ice Tea syrup (Lipton Ice Tea Post-Mix syrup, dilution ratio 1:8, supplied by Unilever) was connected to a centrifugal pump and pump head (14). The conduits were equipped with a valve restricting the water flow and non-return valve (not indicated in FIG. 4). Diameters of the nozzles (16) and (17) and pump heads (14) and (15) for concentrate and water were optimized to create a flow of 200 mL in 10 seconds. With a dilution ratio of 1:8 this resulted in flow rates of 133 mL/min for concentrate, and 1064 mL/min for water. The diameter of the water nozzle was 6 mm, while the diameter of the concentrate nozzle was 1 mm.

Various arrangements of relative positions of water nozzle (17) and concentrate nozzle (16) were tested, see table 1, wherein the horizontal (d) and vertical (h) distances between the centre of the nozzle openings (16*a*, 17*a*) were varied, as well as the angles (a, b) of the nozzles relative to horizontal. In all cases the arrangement of the nozzles was such that they were positioned in such a way that openings (16*a*, 17*a*) were present in the same vertical plane.

Table 1 Results of variation of the arrangement of the nozzles (16) and (17) on quality of dispensing.

TABLE 1

| # | d (mm) | h (mm) | α | β | flow | result |
|---|---|---|---|---|---|---|
| 1 | 7 | 0 | 50° | 90° | pulsating water, pulsating concentrate | spattering |
| 2 | 7 | 0 | 50° | 90° | constant water, pulsating concentrate | good mixing, drops on water nozzle |
| 3 | 7 | 9 | 60° | 80° | constant water, pulsating concentrate | good mixing |
| 4 | 3 | 2 | 60° | 80° | constant water, pulsating concentrate | good mixing, but concentrate spattering on water nozzle |
| 5 | 8 | 4 | 90° | 55° | constant water, pulsating concentrate | good mixing, no spattering |
| 6 | 8 | 4 | 90° | 55° | constant water, constant concentrate | good mixing, no spattering |

d: horizontal distance between centres of nozzle openings
h: vertical distance between centres of nozzle openings (wherein concentrate nozzle is positioned higher than the water nozzle)
α: angle of water nozzle compared to the horizontal (90° is vertical)
β: angle of concentrate nozzle compared to the horizontal (90° is vertical)

Configurations 5 and 6 were the configurations which were best practical application in a beverage dispenser according to the invention.

The invention claimed is:

1. A water cooler comprising:

a cooler housing (2);

a water bottle (1); and a beverage dispenser removably positioned between said cooler housing and said water bottle;

wherein said cooler housing (2) comprises an outlet for dispensing water;

said outlet comprising at least one tap for dispensing chilled water (3) and at least one tap for dispensing water at room temperature (4);

wherein said beverage dispenser comprises:

a dispensing station (19) where a receptacle (18) can be placed or held while a beverage is dosed therein;

a conduit (13) for supply of water from said water cooler to said dispensing station;

a connector (22) for attachment to a container (12) comprising concentrate;

a conduit (23) for supply of concentrate from said container to said dispensing station;

a passage (120) dedicated for water through said dispenser to allow said water bottle to remain in fluid communication with said outlet of said cooler housing (2) when said beverage dispenser is positioned between said cooler housing and said water bottle; and wherein said beverage dispenser does not comprise a mixing chamber;

wherein the water bottle comprises a neck (100) and the cooler housing comprises a recess for receiving the neck of the water bottle, and wherein the dispenser comprises a recess for receiving the neck of the water bottle and a protrusion (150) for being received in the recess of the cooler housing.

2. The water cooler according to claim 1, wherein the beverage dispenser further comprises:

at least one container (12) containing tea-based concentrate;

a dedicated pump head (15) for pumping water from said cooler to said dispensing station;

a dedicated concentrate nozzle (16) for dispensing concentrate at said dispensing station;

a dedicated water nozzle (17) in fluid communication with said dispensing station (19);

wherein said water nozzle and said concentrate nozzle are arranged such that water dispensed from said water nozzle and concentrate dispensed from said concentrate nozzle intersect.

3. The water cooler as claimed in claim 2, wherein the beverage dispenser has an angle (β) of the concentrate nozzle relative to the horizontal of about 25° to about 90°, and an angle (α) of the water nozzle relative to the horizontal of about 45° to about 90°.

4. The beverage dispenser as claimed in claim 2, wherein each of the water nozzle and the concentrate nozzle has a dispensing opening and the horizontal distance (d) between the centres of the openings of the concentrate nozzle and the water nozzle is between 5 and 20 mm.

5. The beverage dispenser as claimed in claim 4, wherein the vertical distance between the centres of the openings of the concentrate nozzle and the water nozzle is between 0 and 20 mm.

6. A water cooler, wherein the water cooler comprises a cooler housing (2) comprising an outlet for dispensing water and a water bottle, and wherein a beverage dispenser is positioned between the cooler housing and the water bottle;

wherein said beverage dispenser (11) comprises:

a dispensing station (19) where a receptacle (18) can be placed or held whilst a beverage is dosed therein, a conduit (13) for supply of water from the water cooler to the dispensing station, a connector (22) for attachment to a container (12) comprising concentrate, a conduit (23) for supply of concentrate from the container to the dispensing station, and wherein the dispenser comprises a passage (120) which is dedicated for water through the dispenser to allow the water bottle to remain in fluid communication with the outlet of the cooler housing when the dispenser is positioned between the cooler housing and the water bottle, and wherein the beverage dispenser does not comprise a mixing chamber; and wherein the water bottle comprises a neck (100) and the cooler housing comprising a recess for receiving the neck of the water bottle, and wherein the dispenser comprises a recess for receiving the neck of the water bottle and a protrusion (150) for being received in the recess of the cooler housing.

7. The water cooler according to claim 6, wherein the outlet of the cooler housing comprises at least one tap for dispensing chilled water (3) and at least one tap for dispensing water at room temperature (4).

8. The water cooler according to claim 6, wherein the dispenser comprises a dedicated pump head (14) for pumping concentrate from the container to the dispensing station.

9. The water cooler according to claim 6, wherein the dispenser comprises a dedicated pump head (15) for pumping water from the cooler to the dispensing station.

* * * * *